US006251249B1

(12) United States Patent
Chevalier et al.

(10) Patent No.: US 6,251,249 B1
(45) Date of Patent: Jun. 26, 2001

(54) PRECIOUS METAL DEPOSITION COMPOSITION AND PROCESS

(75) Inventors: Jean W. Chevalier, Richmond, RI (US); Michael D. Gernon, Upper Providence; Patrick K. Janney, Ridley Park, both of PA (US)

(73) Assignee: Atofina Chemicals, Inc., Philadelphia, PA (US)

( * ) Notice: Subject to any disclaimer, the term of this patent is extended or adjusted under 35 U.S.C. 154(b) by 0 days.

(21) Appl. No.: 09/351,849

(22) Filed: Jul. 13, 1999

Related U.S. Application Data

(63) Continuation-in-part of application No. 08/909,407, filed on Aug. 11, 1997, now abandoned.
(60) Provisional application No. 60/026,973, filed on Sep. 20, 1996.

(51) Int. Cl.[7] ..... C25D 5/00; C25D 5/54; C25D 3/46; H01B 1/02; B05D 3/04

(52) U.S. Cl. ..... 205/80; 205/159; 205/263; 205/265; 205/267; 252/514; 427/304; 427/437

(58) Field of Search ..... 427/437, 304; 252/514; 205/571, 263, 265, 266, 159, 267, 264, 80

(56) References Cited

U.S. PATENT DOCUMENTS

| | | | | |
|---|---|---|---|---|
| 3,616,332 | * | 10/1971 | Miller et al. | 205/571 X |
| 4,478,692 | * | 10/1984 | Nobel | 205/257 |
| 4,614,568 | * | 9/1986 | Okubo et al. | 205/205 |
| 5,391,402 | * | 2/1995 | Melton et al. | 427/437 |
| 5,733,599 | * | 3/1998 | Ferrier et al. | 427/437 X |

* cited by examiner

*Primary Examiner*—Donald R. Valentine
(74) *Attorney, Agent, or Firm*—Gilbert W. Rudman; Stanley A. Marcus

(57) ABSTRACT

Formulations and procedures for the deposition of precious metals onto solid substrates are disclosed wherein the formulations are iodide-free and contain an organosulfur compound and/or a carboxylic acid and a source of soluble precious metal ion which is one or more precious metal alkanesulfonates, precious metal alkanesulfonamides and/or precious metal alkanesulfonimides. The formulations and processes may be cyanide-free, and the deposition may be effected by electrolytic, electroless and/or immersion plating techniques.

19 Claims, No Drawings

PRECIOUS METAL DEPOSITION COMPOSITION AND PROCESS

REFERENCE TO RELATED APPLICATION

This application is a continuation-in-part of U.S. Ser. No. 08/909,407, filed Aug. 11, 1997, now abandoned, which claimed the benefit of U.S. Provisional Application Ser. No. 60/026,973, filed Sep. 20, 1996.

BACKGROUND OF THE INVENTION

1. Field of the Invention

The field of the invention relates to a composition for depositing precious metals on conductive substrates and processes utilizing such compositions.

2. Description of the Prior Art

Depositing of precious metals on to substrates has long been used commercially because the deposits provide desired characteristics, including, attractive appearance, high electrical conductivity, corrosion resistance and good soldering properties.

One of the most common precious metal plating electrolytes used is cyanide based; however, because of cyanide's toxicity, it causes problems in the electroplating working environment and associated waste treatment systems. Many cyanide-free precious metal electroplating systems have been devised to avoid these problems but sometimes the deposits produced from these non-cyanide baths are coarse and do not have as bright an appearance as deposits from cyanide based systems.

Another problem associated with precious metal plating solutions is the tendency for such solutions to immersion plate on active base metal substrates.

Immersion plating (also called displacement plating or substitution plating) occurs when an aqueous solution of a more noble metal ion is contacted with a less noble (more active) metal surface. The more noble ion tends to be reduced to elemental metal by electron donation from the less noble (more active) metal which as a result becomes itself oxidized to an ionic state (e.g., aqua-cation, soluble or insoluble metal oxide).

Metal deposits produced by immersion plating processes are typically limited to relatively low deposit thickness, as contact between the more active metal surface and the more noble metal ion is progressively decreased by the growing immersion layer. When the precious metal layer grows to a non-porous thickness, then the immersion plating stops.

When immersion plating is allowed to proceed in an uncontrolled manner, then a non-adherent metal deposit is obtained. It is advantageous to have cyanide-free precious metal plating solutions which do not operate with uncontrolled immersion plating, as controlled immersion deposits allow for precious metal coatings with superior physical characteristics.

It is known that the addition of certain organic compounds to precious metal plating solutions can usefully control the immersion process. By variation of the addition agents used, one can either control immersion plating to produce bright and adherent precious metal deposits or one can, with certain types of addition agents, completely prevent the immersion deposit from forming.

A number of publications have disclosed the use of organosulfur compounds and/or carboxylic acids in low-cyanide or cyanide-free silver electroplating solutions, and some of these publications address the problem of uncontrolled immersion plating.

For instance, U.S. Pat. No. 4,614,568 discloses a low-cyanide silver electroplating solution which contains a cyclic thioureylene compound additive known to prevent the deposition of silver by displacement reaction.

Also, U.S. Pat. No. 4,247,372 discloses a low-cyanide silver electroplating solution which contains a mercaptan compound additive able to prevent the deposition of silver by displacement reaction.

In addition, U.S. Pat. No. 4,452,673 discloses a low-cyanide silver pretreatment bath and Japanese Patent Application 57-131382 discloses a low-cyanide silver electroplating solution which contains a dithiocarbamic acid or thiosemicarbazide additive able to prevent the deposition of silver by displacement reaction.

Japanese Patent Application 03 061393 published Mar. 18, 1991, discloses a cyanide-free silver electroplating solution which contains a thiocarbonyl compound.

Natarajan (Metal Finishing, February '71, pg.51–56) has surveyed a number of cyanide-free formulations some of which contain completing organosulfur compounds and/or complexing carboxylic acids.

U.S. Pat. No. 4,478,692 describes aqueous electroplating solutions containing soluble palladium compounds and silver compounds, the solutions being capable of depositing a Ag/Pd alloy. Both the palladium and silver compounds may be salts of an alkanesulfonic acid. These silver and/or palladium salts are combined with an acid, which may be an organosulfonic acid, in an amount sufficient to keep the metal compounds in solution during the plating operation.

Kondo et al., Metal Finishing, Oct. 1991, pp. 32–36 describe an aqueous plating solution of silver methanesulfonate, potassium iodide and N-(3-hydroxy-1-butylidene)-p-aminobenzenesulfonic acid (HBPSA). A substantial amount of potassium iodide is a necessary component of this cyanide-free formulation in order to produce a silver electrodeposit on copper with a fine grain structure and appearance.

Japanese patent publication 96/41,676 discloses noble metal electroplating baths free from cyanides containing noble metal ions of alkanesulfonic acids and nonionic surfactants. The applicant states that the coatings formed show almost the same crystalline compactness as do coatings plated from cyanide-containing baths.

The present invention seeks to obtain the advantages of avoiding the above stated problems and other difficulties encountered in the related art.

This invention is distinct from the prior art in that it permits cyanide-free and halogen-free precious metal plating by taking advantage of the high solubility, unique properties, ease of formulation and ease of waste treatment associated with the precious metal salts of the alkanesulfonic acids, alkanesulfonimides and/or alkanesulfonamides; and this invention discloses solution compositions that can, if desired, completely prevent immersion plating.

These and other advantages are obtained according to the present invention which is the provision of a process and composition of matter that substantially obviates one or more of the limitations and disadvantages of the described prior processes and compositions of matter of the related art.

SUMMARY OF THE INVENTION

To achieve these and other advantages, and in accordance with the purpose of the invention, as embodied and broadly described, the invention comprises a composition of matter which allows the use of precious metal alkanesulfonate, precious metal alkanesulfonamide and/or precious metal alkanesulfonimide compounds in an electrodepositing process to produce precious metal coatings.

One embodiment of the invention is a composition of matter for the deposition of precious metals onto a solid, the composition is a cyanide-free and iodide-free aqueous solution containing (i) at least one dissolved precious metal ion supplying compound which is a precious metal alkanesulfonate, precious metal alkanesulfonamide and/or precious metal alkanesulfonimide;(ii) at least one dissolved organic sulfur compound, other than an alkanesulfonic acid, and/or at least one carboxylic acid, and optionally, (iii) an excess of a water soluble alkanesulfonic acid. Another embodiment of the invention is a process for the deposition of precious metal onto a solid substrate. The process comprises (a) contacting said substrate with an iodide-free, aqueous solution containing (i) at least one dissolved precious metal ion supplying compound which is a precious metal alkanesulfonate, precious metal alkanesulfonamide and/or precious metal alkanesulfonimide, (ii) at least one dissolved organosulfur compound, other than an alkanesulfonic acid, and/or at least one carboxylic acid, and optionally, (iii) an excess of alkanesulfonic acid dissolved in said solution; (b) continuing the contact of the substrate until a metallic layer has formed on the substrate and (c) thereafter removing the substrate from the solution.

DETAILED DESCRIPTION OF THE INVENTION

The description which follows sets forth additional features and advantages of the invention which, in part, will become apparent from the description or learned by practice of the invention. The skilled practitioner will realize the objectives and other advantages of the invention obtained by the processes and compositions of matter particularly pointed out in the written description and claims hereof.

The invention described herein identifies several methods for plating, all of which include aqueous formulations (solutions) for the deposition of bright and/or matte coats of precious metal onto a substrate. These formulations allow for the deposition of precious metal by immersion, electroless, and/or electrolytic plating techniques, preferably under cyanide-free conditions.

Deposition Solution in General

The solutions of this invention are preferably completely cyanide-free, and the solution parameters of the solutions of this invention (e.g., pH and temperature) can be easily varied to allow for optimal immersion, electroless and/or electrolytic deposition of precious metal.

The instant invention makes novel use, in combination with the previously described precious metal salts, of selected mercaptans, organic sulfides, sulfamates, alkanesulfonamides, alkanesulfonimides, thiocarbonyl compounds, carboxylic acids and/or substituted carboxylic acids, and the invention allows for the use of low pH (below 1) and high free acid levels (above 1 M) where desirable.

These added compounds sometimes associate with soluble precious metal ions to produce species with a greatly lowered tendency for uncontrolled immersion deposition onto active base metals. If desired, the solution chemistry can be adjusted so that immersion deposition takes place in a controlled manner.

Such controlled immersion deposition can be made to produce bright and adherent coatings of precious metal on, for instance, brass, copper, nickel, base metal alloys and other active (relative to the precious metals) metal substrates. In some cases, the solution chemistry is adjusted so that no immersion deposition takes place. When immersion deposition is completely suppressed, it becomes possible to electroplate precious metal directly onto base metal substrates. Electroless deposition (deposition that is driven by a dissolved reducing agent) can occur with or without associated immersion deposition.

In the practice of this invention any useful combination of immersion, electroless and/or electrolytic deposition may be employed. The solvents employed for the solutions of this invention are aqueous including water alone or mixtures of water and organic solvents, particularly $C_1$ to $C_4$ alcohols.

Precious Metal Compounds

Precious metals, to be useful for this invention, will be capable of forming one or more water soluble precious metal alkanesulfonate, precious metal alkanesulfonamide and/or precious metal alkanesulfonimide compounds, and these precious metal compounds will be amenable to useful plating when admixed with one or more organosulfur compounds and/or carboxylic acids as disclosed herein.

Precious metals include, for example, silver, gold, platinum, palladium, iridium, rhodium, osmium and ruthenium. The preferred precious metals are silver, palladium and gold. The most preferred precious metal is silver.

The precious metal alkanesulfonate, precious metal alkanesulfonamide and/or precious metal alkanesulfonimide compounds can be produced by either ex-situ or in-situ methods. That is, the preformed (ex-situ produced)precious metal alkanesulfonate, sulfonimide and/or sulfonamide may be mixed directly into an aqueous medium to form a plating solution or, if desired, a basic precious metal salt (e.g., precious metal oxide) may be added to an aqueous medium containing a measured amount of alkanesulfonic acid, alkanesulfonimide, and/or alkanesulfonamide to form the soluble precious metal compound in situ.

The alkyl groups of the sulfonyl derived anions of these precious metal compounds may be substituted or unsubstituted. If substituted the substituents preferably are alkyl, hydroxyl, alkoxy, acyloxy, keto, carboxyl, amino, substituted amino, nitro, sulfenyl, sulfinyl, sulfonyl, mercapto, sulfonylamido, disulfonylimido, phosphino, phosphono, carbocyclic or heterocyclic groups. The alkyl groups of the sulfonyl derived anions of these precious metal compounds may contain from 1 to 8 carbon atoms.

Soluble precious metal salts derived from methanesulfonic acid, ethanesulfonic acid, isethionic acid, methionic acid, methanesulfonamide, ethanesulfonamide and dimethanesulfonimide are specific examples of useful precious metal alkanesulfonate, alkanesulfonimide or alkanesulfonamide compounds.

Water soluble precious metal alkanesulfonate salts are the preferred source of the precious metal ions in that such salts are economical to produce, safe, easy to transport, convenient to use and easy to waste treat. To deposit silver, silver methanesulfonate, silver methanesulfonamide and/or silver methanesulfonimide are preferred.

Precious metal alkanesulfonamide compounds and precious metal alkanesulfonimide compounds are useful sources of the precious metal ion when the unique properties of the sulfonamide and/or sulfonimide anion can be put to use.

The concentration of precious metal in an aqueous solution is most conveniently designated by reporting the weight of the precious metal present per liter of solution. For the purposes of this invention, the precious metal concentration may vary from 0.1 g/l to 400 g/l, most preferably from 1 g/l to 150 g/l.

Organosulfur Compounds and Carboxylic Acids

The precious metal plating solutions described herein may include one or more organosulfur compounds, other than alkanesulfonic acid, and/or one or more carboxylic acids.

Useful organosulfur compounds include, for example, certain mercaptans, organic sulfides, alkanesulfonamides, alkanesulfonimides, sulfamates and thiocarbonyl compounds.

Useful mercaptans include alkyl mercaptans, aryl mercaptans and/or heterocyclic mercaptans. The mercaptans may be substituted or unsubstituted. Specific examples of useful mercaptans include thioglycolic acid, 2-mercaptonicotinic acid, 2-thiopropionic acid, 3-thiopropionic acid, monothioglycerol, thiosalicylic acid, cysteine and 2-mercaptothiazoline.

Useful organic sulfides include, for example, dialkyl sulfides, arylalkyl sulfides, diaryl sulfides, heterocyclic sulfides and/or polysulfides. The sulfides may be substituted or unsubstituted. Specific examples of useful organic sulfides include thiodiglycol, methionine, thiodipropionic acid, thiodiglycolic acid, thiazolidine, thiaproline and thiochroman-4-ol. Thiodiglycol is a particularly preferred organic sulfide.

Useful alkanesulfonimides and alkanesulfonamides include all those already described as potential sources of the sulfonyl based anion of the disclosed precious metal compounds. The alkanesulfonimide and/or alkanesulfonamide added as the organosulfur compound component of this invention may be the same as or different from the alkanesulfonimide and/or alkanesulfonamide associated with the precious metal ion source. For instance, silver methanesulfonate might be combined with methanesulfonamide, or alternatively silver methanesulfonamide might be combined with ethanesulfonamide.

The alkyl group of the alkanesulfonimide and alkanesulfonamide may have from 1 to 8 carbon atoms and may be unsubstituted or substituted with $C_{1-8}$ alkyl, hydroxyl, $C_{1-8}$ alkoxy, acyloxy, keto, carboxyl, amino, substituted amine, nitro, sulfenyl, sulfinyl, sulfonyl, mercapto, sulfonylamido, disulfonylimido, phosphino, phosphono, carbocyclic, or heterocyclic groups. Methanesulfonamide, ethanesulfonamide and dimethanesulfonimide are specific examples of useful alkanesulfonamides and alkanesulfonimides. Examples of other appropriate organosulfur compounds include thiourea (substituted or unsubstituted), 3-S-thiuronium propanesulfonate, diethanol disulfide and ethyl xanthate.

Appropriate carboxylic acid frames include aliphatic, aromatic and mixed aliphatic/aromatic backbones. The carboxylic acid may be substituted or unsubstituted. Propionic acid, formic acid, acetic acid,, benzoic acid and phenylacetic acid are specific examples of useful unsubstituted carboxylic acids. Appropriate substituted carboxylic acids include, for example, hydroxyaliphatic, aminoaliphatic, nitroaromatic and hydroxyaromatic carboxylic acids. Citric acid, pyruvic acid, malic acid, glycine, valine, alanine, ethylenediamine tetra-acetic acid, nitrilotriacetic acid, sulfoacetic acid, oxalic acid, malonic acid, succinic acid, glutaric acid, adipic acid, tartaric acid, sulfosuccinic acid, maleic acid, fumaric acid, salicylic acid, toluic acid and lactic acid are specific examples of useful substituted carboxylic acids.

Ratio of Organosulfur Compound and/or Carboxylic Acid to Precious Metal Ion

The ratio of organosulfur compound to precious metal ion may vary from 0 to about 200 (molar basis) with the preferred ratio being between 0 and about 20 (molar basis).

The ratio of carboxylic acid to precious metal ion may vary from 0 to about 200 (molar basis), with the preferred ratio being between 0 and about 20 (molar basis).

The ratio of organosulfur compound and carboxylic acid together to precious metal ion must be between approximately 0.001 and 200 (molar basis) with the preferred ratio being idbetween 0.01 and 20 (molar basis).

Optional Excess Water Soluble Alkanesulfonic Acid

It is within the scope of the present invention to have excess water soluble alkanesulfonic acid present in the electrodeposition solution. By excess is meant more than the stoichiometric amount of alkane sulfonic acid necessary to produce all of the precious metal alkanesulfonate compounds present in the solution.

Mechanism of Action

While not intending to limit the scope of the invention, it is believed that the organosulfur compounds and carboxylic acids added to the precious metal electroplating solutions of the present invention interact with the precious metal ion so that the resultant metal deposit has the proper physical and aesthetic properties (e.g., grain size and color). Such refinement can be obtained (a) through complexation by the organosulfur compound and/or carboxylic acid of the precious metal ion, (b) through general adsorption of the organosulfur compound and/or carboxylic acid to the developing precious metal surface, (c) through selective adsorption of the organosulfur compound and/or carboxylic acid to specific areas of the developing precious metal surface (e.g., high current density areas), and/or (d) through general grain refining by mechanisms not completely understood.

Substrates (Cathode)

The substrates which can be coated include, for example, noble metals, base metals, natural materials (e.g., crustacean shells and arthropod exoskeletons), organic based plastics, glass and ceramics. More particularly, useful substrates can be composed of base and/or precious metals, for example, brass, bronze, silver, gold, palladium, copper, copper alloys, nickel, nickel alloys, iron, iron alloys (e.g., steel), tin, tin alloys, zinc, zinc alloys, aluminum, semiconductor materials, and other metallic and non-metallic materials. The substrates may be in the form of sheets, blocks, aggregates, spheres and/or any regular or irregular shape and the like. of great commercial importance is the deposition of silver onto certain metal substrates used extensively in the electronics industry (e.g., silver spot plating of lead frames). The deposition of precious metals by immersion, electroless and/or electrolytic means onto copper and/or nickel alloy substrates is also a very significant application.

In certain applications of this invention, a thin electrolytic pre-deposit of a precious metal, referred to commonly as a strike, is used to improve the quality of the main precious metal deposit. In certain other applications of this invention, an immersion or electroless deposit of precious metal can take the place of an electrolytic strike. Also, there are applications of this invention which require no precious metal strike prior to the main electroplating operation.

Anodes

The anodes employed may be either soluble or insoluble or mixtures of soluble and insoluble anodes. Soluble anodes will normally be composed of the precious metal being deposited (e.g., Ag anodes will be used for silver plating). Insoluble anodes may be composed of numerous materials capable of generating oxygen by electrolysis of water (e.g., iridium oxide deposited on titanium). Certain precious metals (e.g., Pt, Rh, Ir) will anodically dissolve only with great difficulty, and for plating solutions containing such metals inert anodes are oftentimes the only viable choice. Ruthenium and osmium can be oxidized to toxic and volatile tetroxides (VIII oxidation state), and inert anodes are not recommended for these metals unless the cell has been divided with an anion exchange membrane and the Ru/Os ions are kept exclusively in the catholyte. Silver allows conveniently for the use of soluble anodes (i.e., dissolving pieces of silver).

Other Additives

The deposition solutions of this invention may contain other additives, both novel and traditional, which improve the appearance and physical properties of the precious metal deposit. Exemplary additives include alkanesulfonic acid, alkanolsulfonic acid, anionic surfactants, cationic surfactants, nonionic surfactants, selenium compounds, bismuth compounds, antimony compounds, organonitrogen compounds, substituted urea type compounds, urea, heterocyclic compounds and others. The amount of the other additives necessary varies, but is generally analogous with other systems known in the art. pH The optimal solution pH may vary from below 0 to about 12 depending on the specific application. Low pH solutions (pH=0 to 2) are oftentimes found to be optimal for high speed electroplating and for immersion plating. The ability of certain of the low pH precious metal plating solutions disclosed in this invention to produce compact and adherent precious metal deposits directly on active base metal substrates is unique in the art. Higher pH solutions (pH=5 to 10) are sometimes necessary for direct electroplating onto very active base metals (e.g., zinc alloys). The adjustment of plating solution pH is most preferably carried out by the addition of alkanesulfonic acid, alkanesulfonimide and/or alkanesulfonamide alone or in conjunction with an alkali metal hydroxide, carbonate or alkanecarboxylate.

Temperature

The process of the invention proceeds at a temperature between about 5° C. and 90° C., most preferably between 20° C. and 60° C.

Current Density

For electrolytic deposition, the composition and process of the present invention operates at current densities from about 0.1 Amps/dm2 to about 500 Amps/$dm^2$ and preferably from about 2 Amps/$dm^2$ to about 100 Amps/$dm^2$.

Agitation

In order to prevent "burning" of areas plated at relatively high current density and to provide for more even temperature control of the solution, solution agitation may be employed ranging from none to vigorous and, preferably, moderate to vigorous. Air agitation, mechanical stirring, pumping, cathode rod and other means of solution agitation are all satisfactory.

Electroless Plating

When electroless plating is sought, then the deposition solution shall also contain a dissolved reducing agent. The electroless deposition can occur with or without associated immersion deposition. Useful reducing agents for electroless plating are known in the art and include L-ascorbic acid, reducing sugars and formaldehyde. Novel reducing agents discovered during the course of this work include hydroxylamine-O-sulfonic acid, hydroxylammonium methanesulfonate and hydroxylammonium ethanesulfonate.

A preferred aqueous silver solution suitable for electroless plating is comprised of

| | |
|---|---|
| Silver methanesulfonate | 20–30 g/L |
| Hydroxylamine-O-sulfonic acid | 10–30 g/L |
| Methanesulfonic Acid | 10–20% v/v |
| Thiodiglycol | 5–10 ml/L |
| Additives | 0.5–10 g/l |

The following examples are set forth to demonstrate the composition and process of this invention but are not to be interpreted as narrowing the scope thereof.

The amount of precious metal contained in these exemplary plating solutions, unless otherwise indicated, is reported based on the weight of metal, as is common in the art. MSA is methanesulfonic acid. The aryl polyether surfactant (HLB =15) employed was Syn Fac 8216 as sold by Milliken.

In Examples 3–8, reference is made to the use of the Hull Cell for plating experiments. The Hull Cell and its use are well understood by those practiced in the plating art. The Cell is a shaped plastic box in which small scale plating experiments can be conducted. A panel (oftentimes referred to as a Hull Cell panel) is suspended in a deposition solution contained in the Hull Cell, and then the panel is plated. The plated Hull Cell panel is examined and tested to determine the utility of the plating solution.

EXAMPLE 1

A—An aqueous silver deposition solution suitable for immersion plating was prepared from the following components:

| | |
|---|---|
| Silver methanesulfonate | 5 g/l as Ag |
| Sulfamic acid | 5 g/l |
| Thiodiglycol | 10 g/l |
| Aryl polyether surfactant (HLB = 15) | 3 g/l |
| Sufficient additional $H_2NSO_3H$ to adjust pH to 2 | |

B—A brass plated steel Hull Cell panel was cathodically degreased in a phosphate cleaner solution (50 g/L $Na_2HPO_4$, 50 ASF cathodic) for 2 minutes. The panel was rinsed with deionized (DI) water then descaled in 10% MSA(aq). The panel was rinsed again with DI water and then dipped into the above-described silver immersion deposition solution for 2 minutes. The panel was removed from the solution, rinsed thoroughly with DI water and dried. X-ray fluorescence (XRF) analysis of the panel established that 0.2 microns of silver had been deposited on the brass. The silver deposit was uniform, bright and adherent.

EXAMPLE 2

A—An aqueous silver deposition solution suitable for immersion plating was prepared as follows:

| | |
|---|---|
| Silver ethanesulfonate | 70 g/l as Ag |
| 2-Mercaptothiazoline | 40 g/l |
| Thiodiglycol | 40 g/l |

Add sufficient 70% MSA(aq) to obtain complete dissolution The above mixture was stirred rapidly for 30 minutes and then filtered through a 1 micron glass microfiber pad. Initially, the solution was clear with a light yellow-green color, but the color changed to dark brown overnight.

B—A brass plated steel Hull Cell panel was cathodically degreased in a phosphate cleaner solution as described in Example 1. The panel was rinsed with DI water and then dipped into the immersion deposition solution described above for 60 seconds. The panel was removed from the silver deposition solution, rinsed thoroughly with DI water and dried. XRF analysis of the panel established that a 0.3 micron layer of silver had been deposited. The silver deposit was uniform, bright and adherent.

C—A copper plated Hull Cell panel was treated as above; a 0.05 micron layer of bright silver was deposited in 60 seconds. XPS analysis with neon ion milling (electron binding energy scan from 0 to 1400 eV) of silver deposits produced by the above described process showed no evidence of the incorporation of sulfur in the bulk deposit or at the deposit/substrate interface.

EXAMPLE 3

An aqueous of solution of Pd(II) suitable for immersion plating was made as follows:

A—Production of Palladium Methanesulfonate

Palladium powder (approximately 1 micron particle size) was oxidatively dissolved into nitric acid with 0.1 mole % of added chloride (catalyst). The palladium nitrate formed was precipitated as brown hydrous palladium oxide by the addition of an appropriate amount of base (caustic or carbonate). The palladium oxide was collected by vacuum filtration and then redissolved into 70% methanesulfonic acid.

B—Composition of aqueous palladium plating solution.

A bath was prepared as follows:

| | |
|---|---|
| Palladium Methanesulfonate | 5 g/l as Pd |
| Citric Acid | 25 g/l |

C—Immersion Plating The bath of section B was used to deposit palladium by an immersion process on brass plated steel Hull Cell panels. The cleaning and pretreatment procedures used prior to plating were identical to those described in Examples 1 & 2. The bath was, prior to testing, aged by immersion plating until a point where 180 ppm Cu(II), 110 ppm Fe(II) and 40 ppm Zn(II) (all byproducts of the immersion plating process) had built-up in the solution. After aging, a test piece was plated and found to be coated with 0.1 micron of palladium after 1 minute of immersion. The palladium deposited was uniformly bright, reflective and adherent.

EXAMPLE 4

A—An aqueous silver solution suitable for electroplating was prepared as follows:

| | |
|---|---|
| Silver methanesulfonate | 80 g/l as Ag |
| Citric acid | 20 g/l |
| Thiodiglycol | 4 g/l |
| Aryl polyether surfactant (HLB = 15) | 1 g/l |
| Ammonium Perfluorooctanesulfonate | 0.2 g/l |
| Ethylene Urea | 0.5 g/l |

Add 70% MSA (aq) to adjust the pH to between 1 and 2

B—A brass plated steel Hull Cell panel was cathodically degreased in a phosphate cleaner solution as described in Example 1. The panel was rinsed with DI water and then descaled in 10% MSA(aq). The panel was rinsed again with DI water and then dipped into the immersion deposition solution described in Example 1 for 2 minutes. The panel was rinsed again with DI water and then electroplated at 2 amps for 1 minute in a Hull Cell which contained the above described electroplating solution. The plated Hull Cell panel was rinsed and dried. XRF analysis of the panel established that 5.75 microns of silver had been deposited at a nominal current density of 8 amp/dm$^2$. The deposit was uniform, bright and adherent between the nominal current densities of 1 and 10 amp/dm$^2$.

C—If the silver solution described in this example was used to directly electroplate silver on copper or brass substrates without an initial silver strike, then typically a loose and non-adherent silver deposit was obtained.

EXAMPLE 5

An aqueous silver solution suitable for electroplating was made as follows:

A—Potassium silver dimethanesulfonimide (PSDMS) was prepared as follows: 100 grams of MSIH ($[MeSO_2]_2NH$, GMW=173, 0.578 moles) was suspended in 300 ml of DI $H_2O$, and 18.4 grams of 88% KOH (0.289 moles) dissolved in 100 ml of DI $H_2O$ as slowly added to the suspension over 5 minutes such that the temperature was kept below 40° C. The resulting aqueous MSI/MSIH solution was stirred until it became homogeneous (pH=1 to 2), and then 33.486 grams of powdered silver oxide (0.1445 moles, 0.289 moles of $Ag^+$) was added over 10 minutes. The total solution volume was brought to 600 ml with DI $H_2O$. The heterogeneous solution was stirred for 24 hours at room temperature during which time most of the silver oxide dissolved. The solution was then filtered through a 1 micron glass microfibre pad to yield a clear filtrate. The filtrate was evaporated in-vacuo (30 mm Hg), and the resulting residual solid was washed with 100 ml of diethyl ether. The solid product was reduced to constant weight in-vacuo (1 mm Hg). The resulting white solid was found to contain 20% by weight of Ag [$KAg(MSI)_2$ with a GMW=490.97 contains a theoretical 22% Ag by weight] using an ICP/emission technique (ICP represents inductively coupled plasma). The product was further purified by recrystallization from $H_2O$. The best result was obtained when a saturated PSDMS(aq) solution was allowed to slowly evaporate over several days. With slow evaporation, large crystals of PSDMS could be obtained. Total recrystallization yields in excess of 98% were obtained by continuing to evaporate PSDMS(aq) solutions to near dryness.

B—Using the PSDMS prepared above, an aqueous silver plating solution was prepared as follows:

| | |
|---|---|
| Potassium silver dimethanesulfonimide | 200 g/l as salt |
| Citric acid | 20 g/l |
| Thiodiglycol | 4 g/l |
| Aryl polyether surfactant (HLB = 15) | 1 g/l |
| Ammonium Perfluorooctanesulfonate | 0.2 g/l |
| Ethylene Urea | 0.5 g/l |

Add dilute KOH(aq) until the pH =6

Use MSIH to lower the pH if too much KOH(aq) is added

C—A brass plated steel Hull Cell panel was cathodically degreased in a phosphate cleaner solution. The panel was rinsed with DI water and then descaled in 10% MSA(aq). The panel was rinsed again with DI water and then dipped into the immersion deposition solution described in Example 1 for 2 minutes. The panel was rinsed with DI water and then electroplated at 3 amps for 1 minute in a Hull Cell filled with the above described solution. The plated Hull Cell panel was rinsed and dried. XRF analysis of the panel indicated that 7.50 microns of silver had been deposited at a nominal current density of 9 amps/dm$^2$. The deposit was uniform, bright and adherent between the nominal current densities of 1 and 12 amp/dm$^2$.

D—When the silver solution described in this example was used to directly electroplate silver on copper or brass substrates without an initial silver strike, then typically a matte and non-adherent Ag deposit was obtained.

EXAMPLE 6

A—An aqueous silver solution suitable for electroplating was prepared as follows:

| | |
|---|---|
| Silver methanesulfonate | 55 g/l as Ag |
| Thiodiglycol | 100 g/l |

-continued

| | |
|---|---|
| 2-Mercaptothiazoline | 3 g/l |
| 70% MSA (aq) | 70 g/l |

B—A brass plated steel Hull Cell panel was cathodically degreased in a phosphate cleaner solution. The panel was rinsed with DI water and then descaled in 10% MSA(aq). The panel was again rinsed with DI water and then electroplated at 1 amp for 1 minute in a Hull Cell containing the above described solution. The plated panel was rinsed and dried. XRF analysis of the panel indicated that 1.5 microns of silver had been deposited at a nominal current density of 1.2 amps/dm$^2$ The deposit was uniform, bright and adherent between the nominal current densities of 0.4 and 1.2 amps/dm$^2$.

C—The silver solution described in this example was used to directly electroplate on copper and brass substrates with good results. Nonadherent immersion deposition was not evident even when brass plated pieces were dipped for extended periods of time (up to 10 minutes) into the electroplating solution described.

EXAMPLE 7

A—An aqueous silver solution suitable for electroless plating was prepared as follows:

| | |
|---|---|
| Silver methanesulfonate | 25 g/l as Ag |
| Thiodiglycol | 8 ml/l |
| 2-Mercaptothiazoline | 4 g/l |
| Methanesulfonic acid | 15% v/v |
| Benzenesulfinic acid | 1 g/l |
| Hydroxylamine-O-sulfonic acid | 20 g/l |
| Temperature | 50° C. |
| Agitation | Moderate |

B—The above described solution was capable of depositing about 4 microns per hour of bright and adherent silver on a copper plated Hull Cell panel placed in a beaker containing the solution. The copper substrate was activated with 10% MSA(aq) prior to electroless plating.

EXAMPLE 8

A—An aqueous silver solution suitable for high speed electroplating was prepared as follows:

| | |
|---|---|
| Silver methanesulfonate | 80 g/l as Ag |
| Citric Acid | 30 g/l |
| Methane Sulfonic Acid | 15% v/v |
| Ammonium Perfluorooctanesulfonate | 200 mg/l |
| Ethylene Urea (brightener) | 100 mg/l |
| 3-S-thiuronium propyl sulfonate | 5 g/l |

B—A brass plated steel Hull Cell panel was cathodically degreased in a phosphate cleaner solution. The panel was rinsed with DI water and then descaled in 10% MSA(aq). The panel was again rinsed and then plated with about 0.4 microns of Ni from a sulfamate based Ni plating electrolyte (approximately 30 g/L of nickel sulfamate). The Ni plated piece was then cathodically scrubbed in an alkaline phosphate cleaner (composition given in Example 1), rinsed, descaled by immersion in 10% MSA(aq) [an effective descale is critical in order to obtain good adhesion of the electroplated silver] and then rinsed again with DI water. The piece was next electroplated at 10 amps for 1 minute in a Hull Cell containing the above described silver plating solution. The plated panel was rinsed and dried. XRF analysis of the panel demonstrated that 20 microns of silver had been deposited in one minute at a nominal current density of 40 amps/dm$^2$. The deposit was uniform, bright and adherent between the nominal current densities of 0.1 and 50 amps/dm$^2$. Analysis of the silver deposit showed it to be 99.988% pure with a hardness between 60 and 70 Knoops.

EXAMPLE 9

The following aqueous solution compositions are typical of formulations which completely suppress the immersion deposition of silver on brass substrates.

| | |
|---|---|
| Solution A | |
| Silver methanesulfonate | 200 g/l as Ag |
| Thioglycolic acid | 200 g/l |
| KOH (86%) | 200 g/l |
| Further KOH (aq) as needed to adjust pH to 8 | |
| Solution B | |
| Silver ethanesulfonate | 100 g/l as Ag |
| 3-Mercaptopropionic acid | 110 g/l |
| KOH (86%) | 100 g/l |
| Further KOH (aq) as needed to adjust pH to 8 | |
| Solution C | |
| Silver methanesulfonate | 70 g/l as Ag |
| 2-Mercaptonicotinic acid | 100 g/l |
| KOH (86%) | 65 g/l |
| Further KOH(aq) as needed to adjust pH to 8 | |

Throughout the specification, the inventors refer to various materials used in their invention as based on certain components, and intend that they contain substantially these components, or that these components comprise at least the base components in these materials.

It will be apparent to those skilled in the art that various modifications and variations can be made to the composition and process of this invention without departing from the spirit or scope of the invention. It is intended that these modifications and variations of this invention are to be included as part of the invention, provided that they come within the scope of the appended claims and their equivalents.

What is claimed is:

1. A composition for the deposition of precious metals comprising an iodide-free and cyanide-free aqueous solution of (i) at least one dissolved precious metal-ion supplying compound which is a precious metal alkanesulfonate, precious metal alkanesulfonamide or precious metal alkanesulfonimide;

(ii) at least one dissolved organosulfur compound or carboxylic acid; wherein said organosulfur compound is an alkyl mercaptan, aryl mercaptan, heterocyclic mercaptan, dialkyl sulfide, diaryl sulfide, aryl alkyl sulfide, organic disulfide, organic polysulfide, organic xanthate, organic thiocyanate, or thiourea and wherein said carboxylic acid is an alkanecarboxylic acid, aromatic carboxylic acid, alpha-amino acid, amino acid, dicarboxylic acid or polycarboxylic acid; and (iii) optionally, a dissolved alkanesulfonic acid; wherein the alkane groups of said precious metal alkanesulfonates, precious metal alkanesulfonamides and precious metal alkanesulfonimides are substituted or unsubstituted and have 1 to 8 carbon atoms, wherein the substituent groups are alkyl, hydroxyl, alkoxy, acyloxy, keto, carboxyl, amino, substituted amino, nitro, sulfenyl, sulfinyl, sulfonyl, mercapto, sulfonylamido, disulfonylimido, phosphino, phosphono, carbocyclic, or heterocyclic, wherein the alkyl groups contain 1 to 8 carbon atoms.

2. The composition of claim 1 wherein the precious metal ion supplying-compound is silver methanesulfonate, silver methanesulfonamide or silver dimethanesulfonimide.

3. The composition of claim 1 wherein said organosulfur compound is thioglycolic acid, 2-mercaptonicotinic acid, 2-thiopropionic acid, 3-thiopropionic acid, cysteine, 2-mercaptothiazoline, monothioglycerol, thiosalicylic acid, thiodiglycol, methionine, thiodipropionic acid, thiodiglycolic acid, thiazolidine, thiaproline, thiochroman-4-ol or sulfamic acid.

4. The composition of claim 3 wherein said organosulfur compound is thiodiglycol present in said solution in an amount ranging from about 0.001 g/L to about 500 g/L.

5. The composition of claim 1 wherein said carboxylic acid is propionic acid, formic acid, acetic acid, benzoic acid, phenylacetic acid, citric acid, pyruvic acid, malic acid, glycine, valine, alanine, ethylenediamine tetra-acetic acid, nitrilotriacetic acid, sulfoacetic acid, oxalic acid, malonic acid, succinic acid, glutaric acid, adipic acid, tartaric acid, sulfosuccinic acid, maleic acid, fumaric acid, salicylic acid, toluic acid or lactic acid.

6. The composition of claim 1 wherein said organosulfur compound is an alkanesulfonimide or alkanesulfonamide wherein the alkane groups are substituted or unsubstituted and have from 1 to 8 carbon atoms, the substituent groups being alkyl, hydroxyl, alkoxy, acyloxy, keto, carboxyl, amino, substituted amino, nitro, sulfenyl, sulfinyl, sulfonyl, mercapto, sulfonylamido, disulfonylimido, phosphino, phosphono, carbocyclic, or heterocyclic.

7. The composition of claim 1 wherein said composition further comprises a reducing agent useful for electroless plating.

8. The composition of claim 7 wherein said reducing agent is hydroxylamine-O-sulfonic acid, hydrokylammonium methanesulfonate or hydroxylammonium ethanesulfonate.

9. A process for the electrodeposition of precious metal onto a solid substrate, the process comprising (a) contacting said substrate with an iodide-free, aqueous solution of (i) at least one water soluble, precious metal-ion supplying compound which is a precious metal alkanesulfonate, precious metal alkanesulfonamide or precious metal alkanesulfonimide, (ii) at least one organosulfur compound, other than alkanesulfonic acids, or carboxylic acid, wherein said organosulfur compound is an alkyl mercaptan, aryl mercaptan, heterocyclic mercaptan, dialkyl sulfide, diaryl sulfide, aryl alkyl sulfide, organic disulfide, organic polysulfide, organic xanthate, organic thiocyanate, or thiourea, or carboxylic acid, which is soluble in said solution, and wherein said carboxylic acid is an alkanecarboxylic acid, aromatic carboxylic acid, alpha-amino acid, amino acid, dicarboxylic acid or polycarboxylic acid, (iii) optionally, an alkanesulfonic acid which is soluble in said solution, (b) continuing the contact until a precious metal layer of the desired thickness forms on said substrate, and (c) thereafter removing said substrate from said solution; wherein said precious metal is silver, palladium or gold and said organosulfur compound or carboxylic acid is present in an amount of from about 0.001 to about 200 moles per mole of precious metal ion(s) present in said solution.

10. The process of claim 9 wherein said substrate is composed of brass, bronze, silver, gold, palladium, copper, copper alloys, nickel, nickel alloys, iron, iron alloys, tin, tin alloys, zinc, zinc alloys, aluminum or organic based plastics.

11. The process of claim 9 wherein the precious metal ion supplying compound is silver methanesulfonate, silver methanesulfonamide or silver dimethanesulfonimide.

12. The process of claim 9 wherein said organosulfur compound is thioglycolic acid, 2-mercaptonicotinic acid, 2-thiopropionic acid, 3-thiopropionic acid, cysteine, 2-mercaptothiazoline, monothioglycerol, thiosalicylic acid, thiodiglycol, methionine, thiodipropionic acid, thiodiglycolic acid, thiazolidine, thiaproline, thiochroman-4-ol or sulfamic acid.

13. The process of claim 9 wherein said organosulfur compound is thiodiglycol present in said solution in an amount ranging from about 0.001 g/L to about 500 g/L.

14. The process of claim 9 wherein said carboxylic acid is propionic acid, formic acid, acetic acid, benzoic acid, phenylacetic acid, citric acid, pyruvic acid, malic acid, glycine, valine, alanine, ethylenediamine tetra-acetic acid, nitrilotriacetic acid, sulfoacetic acid, oxalic acid, malonic acid, succinic acid, glutaric acid, adipic acid, tartaric acid, sulfosuccinic acid, maleic acid, fumaric acid, salicylic acid, toluic acid or lactic acid.

15. The process of claim 9 wherein said organosulfur compound is an alkanesulfonimide or alkanesulfonamide wherein the alkane groups are substituted or unsubstituted and have from 1 to 8 carbon atoms, the substituent groups being alkyl, hydroxyl, alkoxy, acyloxy, keto, carboxyl, amino, substituted amino, nitro, sulfenyl, sulfinyl, sulfonyl, mercapto, sulfonylamido, disulfonylimido, phosphino, phosphono, carbocyclic, or heterocyclic.

16. The process of claim 9 wherein said organosulfur compound is an alkanesulfonimide or alkanesulfonamide wherein the alkane groups are substituted or unsubstituted and have 1 to 8 carbon atoms, the substituent group being alkyl, hydroxyl, alkoxy, acyloxy, keto, carboxyl, amino, substituted amino, nitro, sulfenyl, sulfinyl, sulfonyl, mercapto, sulfonylamido, disulfonylimido, phosphino, phosphono, carbocyclic, or heterocyclic.

17. The process of claim 9 wherein said deposition is produced by electrolytic, electroless or immersion plating techniques.

18. The process of claim 9 wherein said deposition is produced by electroless plating and said organosulfur compound is a reducing agent.

19. The process of claim 18 wherein said reducing agent is hydroxylamine-O-sulfonic acid, hydroxylammonium methanesulfonate or hydroxylammonium ethanesulfonate.

* * * * *